US006305029B1

(12) United States Patent
Reynolds

(10) Patent No.: US 6,305,029 B1
(45) Date of Patent: Oct. 23, 2001

(54) PROTECTIVE HEADWEAR WITH DECORATIVE AND UTILITARIAN ATTACHMENTS

(76) Inventor: R. Brent Reynolds, 230 Aviation Dr., Winchester, VA (US) 22602

( * ) Notice: Subject to any disclaimer, the term of this patent is extended or adjusted under 35 U.S.C. 154(b) by 0 days.

(21) Appl. No.: 09/609,772

(22) Filed: Jul. 3, 2000

(51) Int. Cl.[7] ..... A42B 1/24

(52) U.S. Cl. ..... 2/422; 2/171; 2/172; 2/205; 2/423

(58) Field of Search ..... 2/421, 410, 411, 2/413, 414, 175.4, 195.1, 195.5, DIG. 1, 171, 422, 423, 6.6, 172, 205, 209.12

(56) References Cited

U.S. PATENT DOCUMENTS 1,332,883 * 3/1920 Breslaw ..... 2/172 X
1,505,978 * 8/1924 Stetson ..... 2/172 X
2,289,345 * 7/1942 Craig et al. ..... 2/410
3,046,560 * 7/1962 De Grazia ..... 2/6.6
3,055,012 * 9/1962 Aileo ..... 2/410
3,518,701 * 7/1970 Fekete ..... 2/172
4,633,530 * 1/1987 Satterfield ..... 2/423
4,951,319 * 8/1990 Phillips ..... 2/171
5,887,289 * 3/1999 Theoret ..... 2/195.1 X

* cited by examiner

*Primary Examiner*—Rodney M. Lindsey
(74) *Attorney, Agent, or Firm*—Roylance, Abrams, Berdo & Goodman, L.L.P.

(57) ABSTRACT

Protective headwear including a cover and a liner permanently attached to a hard hat. The cover and liner members provide protection against inclement weather conditions. In particular side, front, and rear flaps can be pivoted between folded and unfolded positions such that the protective headwear can be used in both bad and good weather conditions. The liner, being formed of fur, is both decorative and utilitarian in providing protection against cold weather.

8 Claims, 2 Drawing Sheets

PROTECTIVE HEADWEAR WITH DECORATIVE AND UTILITARIAN ATTACHMENTS

BACKGROUND OF THE INVENTION

Protective headwear, such as a hard hats, are typically employed to provide protection to the wearer while involved in potentially hazardous activities, such as construction. In particular, hard hats protect against blows to the head of the wearer.

Prior art hard hats, however, fail to adequately provide protection against inclement weather conditions often faced by construction workers and the like. In an attempt to provide protection against weather conditions, some prior art hard hats employ attachments such as flaps. However, because these attachments are not permanently fixed to the hard hat, they often disengage from the hard hat and fall off. In addition, the attachments of the prior art hard hats are inadequate since they cover only a small portion of the wearer's head, face, and neck. Furthermore, none of the prior art hard hats provide protective attachments wherein the hard hat can be employed in both good and bad weather conditions.

SUMMARY OF THE INVENTION

Accordingly, an object of the present invention is to provide protective headwear that provides full and adequate protection to the wearer against various weather conditions, including very cold climate conditions.

Another object of the present invention is to provide protective headwear with a cover or attachment that is permanently attached thereby preventing the attachment from falling off.

A further object of the present invention is to provide protective headwear with a cover having a plurality of side flaps and an inner liner for protection against inclement weather conditions.

Yet another object of the present invention is to provide protective headwear that can be employed in both good and bad weather.

A yet further object of the present invention is to provide protective headwear with attachments that are decorative and aesthetically pleasing while providing protection against inclement weather conditions.

The foregoing objects are basically attained by protective headwear comprising a crown member having an inner surface and an outer surface, a cover member disposed on the crown member, the cover member including, a main panel fixedly attached to the outer surface of the crown member, opposing first and second side panels extending from the main panel beyond the crown member, the first side panel includes a first surface, and the second side panel includes a second surface; and a liner being disposed on each of the first and second surfaces of the first and second side panels, respectively.

By designing the protective headwear in this fashion, the wearer is provided with complete protection against accidental blows to the head and inclement weather conditions. In addition, the headwear is aesthetically pleasing and can be employed in both good and bad weather conditions.

Other objects, advantages and salient features of the invention will become apparent from the following detailed description which taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
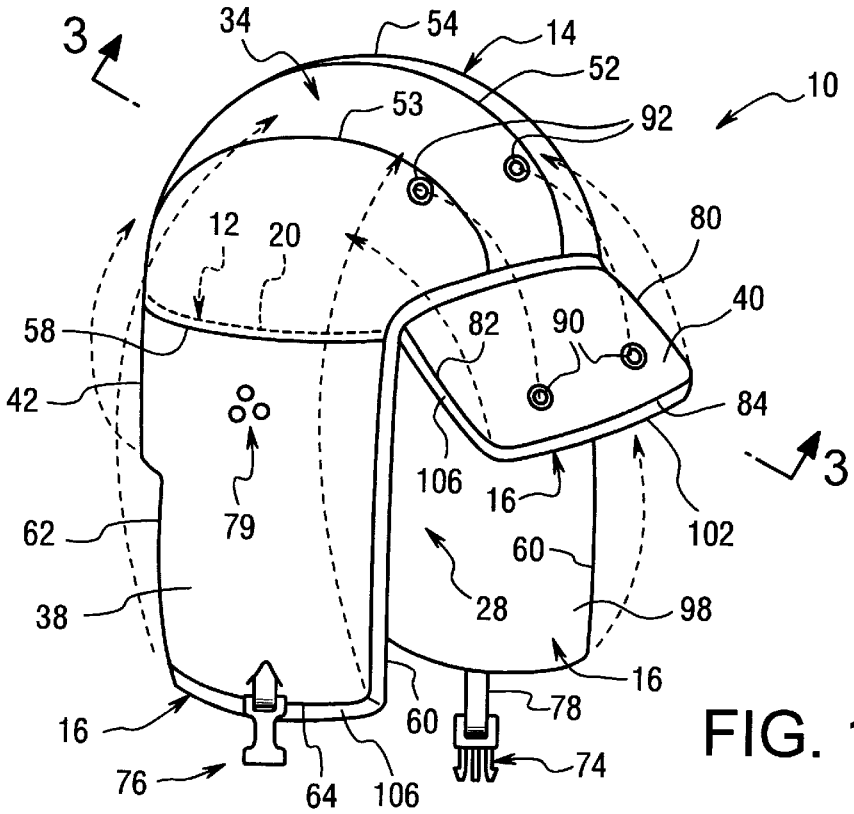
FIG. 1 is left, front, perspective view of protective headwear according to an embodiment of the present invention, illustrating the protective cover and liner.
Figure 2:
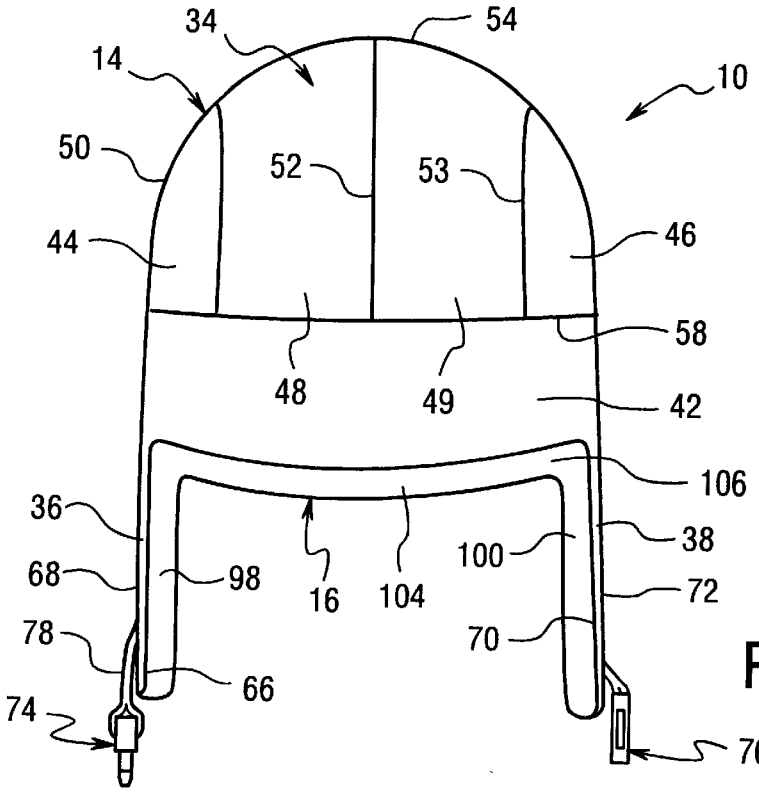
FIG. 2 is rear elevational view of the protective headwear illustrated in FIG. 1.
Figure 3:
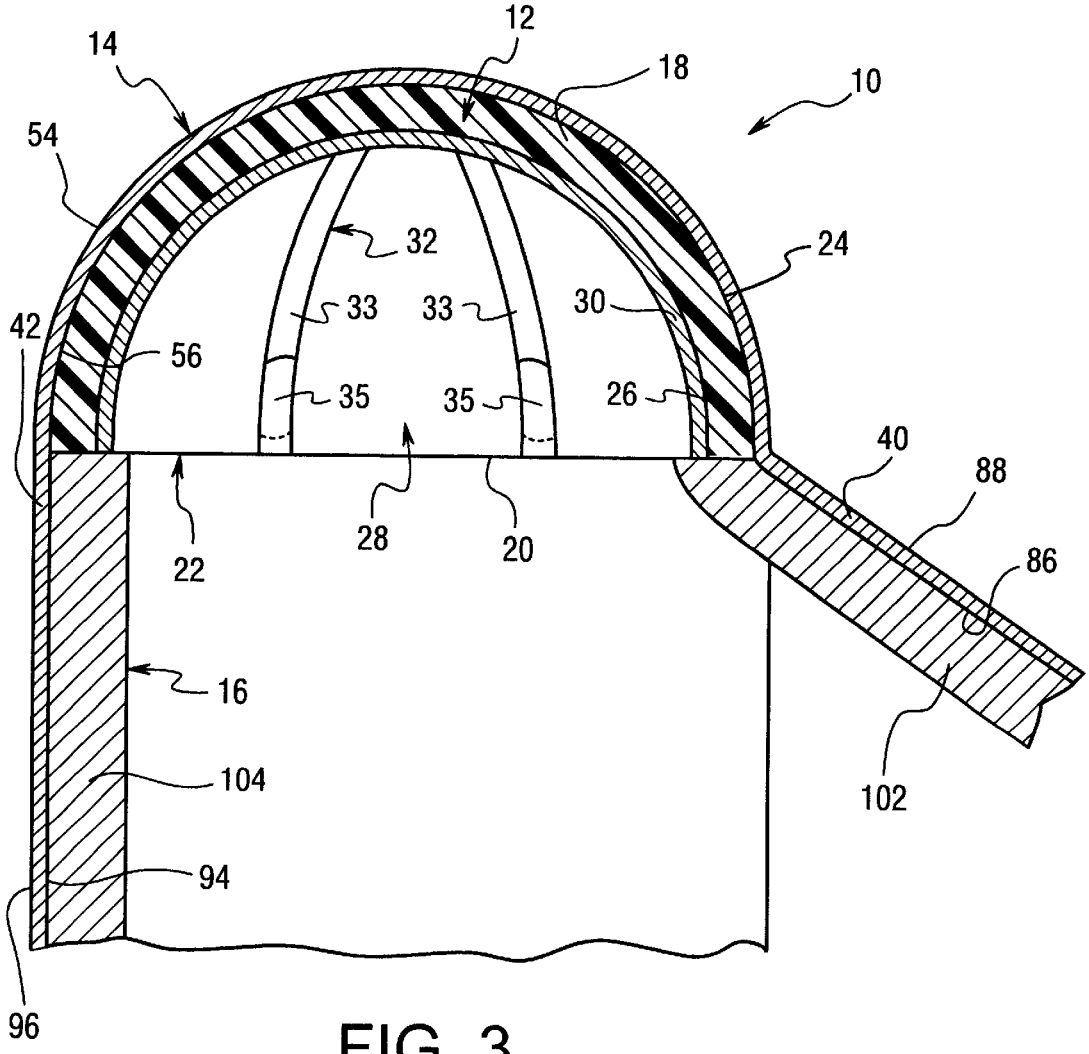
FIG. 3 is a cross sectional view taken along line 3—3 of FIG. 1, illustrating a hard hat, the protective cover, and the protective liner of the present invention.

Referring to FIGS. 1–3, protective headwear 10 according to the present invention includes a crown member 12 having a cover member 14 disposed over crown member 12 with a liner 16 disposed on the inside of cover member 14.

Crown member 12 is a defined by a hard hat, as known in the art, having a crown section 18 and a free edge 20 at a bottom periphery 22 of the crown section 18. Crown member 12 further includes a convex outer surface 24 and a concave inner surface 26 forming a substantially semi-circular shaped crown member 12 in cross section, as best seen in FIG. 3, having an inner receiving area 28 for receiving the head of a wearer (not shown), such that free edge 20 is above the ears of the wearer when placed on the wearer's head. Crown member 12 is preferably formed of any rigid or semi-rigid material that can withstand impact, such as plastic, as is well known in the art.

An inner crown liner 30, preferably formed of any fabric material, may be alternatively attached to inner surface 26 to provide comfort and support to the wearer. Liner 30 can be secured to crown member 12 by any known attachment, such as by adhesive or by fasteners. Liner 30 can also be sewn to cover member 14, as will described below.

In addition, adjustable straps 32, may be included within inner receiving area 28 along inner surface 26 to allow the wearer to easily adjust inner receiving area 28 according to the head size of the wearer. Each adjustable strap 32 preferably includes top and bottom plastic snapping sections 33 and 35 with the bottom section 35 being fixedly attached to the crown member 12, wherein the two sections 33 and 35 can be snapped in various locations to provide the desired size. In addition, the top sections 33 of each straps 32 are joined at their top ends. It will be understood that any number of adjustable straps can be employed and is not limited to just two. By changing the location of the engagement between sections 33 and 35 of each strap 32, the straps can be made either shorter or longer to adjust to the size of the wearer's head.

Alternatively, a plurality of flexible straps (not shown) having loops at each of their distal ends and being attached to crown member 12 at each of their opposing ends. A string can be inserted through all of the loops and tied according to the desired size. By tying the loops together, either tightly or loosely, the flexible straps can adjust according to the size of the wearer's head.

Cover member 14 is disposed over crown member 12 providing protection to the wearer from the elements such as wet and cold weather. Cover member 14 includes a main panel 34, a first or right side panel or flap 36, a second or left side panel or flap 38 opposing right panel or flap 36, a third or front side panel or flap 40 extending between right and left panels 36 and 38, and a fourth or rear side panel 42 opposing front panel 40. Cover member 14 is preferably formed of a fabric material, such as NYLON or canvas. However, cover member 14 can be formed of any flexible fabric material, preferable material that is water-resistant or water proof.

Main panel 34 particularly includes fourt attached sections, two outer sections 44 and 46 and two middle sections 48 and 49 therebetween, preferably attached by sewn or seams lines 50, 52 and 53 such that main panel 34 has substantially the same shape as crown member 12. Main panel 34 also has an outer surface 54 and an inner surface 56 with a bottom peripheral edge 58 corresponding to free edge 20 of crown member 12 such that main panel 34 either substantially covers or entirely covers crown section 18.

Main panel 34 is fixedly attached to crown section 18, specifically, to inner crown liner 30 at the bottom periphery 22 of crown member 12 by a sewing attachment or a fastener, thereby preventing main panel 34 and cover member 14 from falling off of crown member 12. However, main panel 34 can be attached to crown section 18 in any known manner, such as adhesive, as long as cover member is prevented from releasing from of crown member 12.

Bottom peripheral edge 58 further includes opposing right and left sections 60 and 62, and opposing front and rear sections 64 and 66 wherein right and left panels 36 and 38 extend downwardly from right and left sections 60 and 62 of bottom peripheral edge 58, respectively, and front and rear panels 40 and 42 extend downwardly from front and rear sections 64 and 66 respectively.

Right and left panels 36 and 38 are substantially identical and provide protection for the wearer, specifically the wearer's ears, face, and neck. Each of panels 36 and 38 extend downwardly past the ears of the wearer and along the neck with opposing and substantially parallel front and back free edges 60 and 62, and a bottom free edge 64 extending therebetween. Right panel 36 further includes a first or inner surface 66 and an outer surface 68, and left panel further includes a second or inner surface 70 and an outer surface 72. Each of right and left panels 36 and 38 include corresponding first and second fasteners 74 and 76 on their outer surfaces 68 and 72, respectively, proximate bottom edge 64. First and second fasteners 74 and 76 are defined by a male and female clasping members. First fastener 76 further includes a flexible adjustable strap 78 allowing the wearing to adjust first and second fasteners 74 and 76 when they are engaged. It will be understood by those skilled in the art that first and second fasteners 74 and 76 can be any known fasteners, such as VELCRO, snaps, or straps that are simply tied together. Right and left panels 36 and 38 can also alternatively include air holes 79 that extend through both each of the panels 36 and 38 and liner member 16.

Front panel 40 extends downwardly between the front free edges 60 of right and left panels 36 and 38 for protecting the wearer's face and includes opposing, substantially parallel side free edges 80 and 82, and a bottom free edge 84 extending there between. Front panel 40 further includes a third or inner surface 86 and an outer surface 88 and is substantially shorter than right and left panels 36 and 38. Outer surface 88 also has a pair of third fasteners 90 that correspond to a pair of fourth fasteners 92 disposed on main panel 34 spaced from its peripheral edge 58 near a front portion of crown member 12, as best seen in FIG. 1. Third and fourth fasteners 90 and 92 are preferably snaps. Although it is preferable to have a pair of snap fasteners, only one snap fastener on each of the main and front panels 34 and 40 is required. In addition, it will be understood by those skilled in the art that any type of known fastener can be used to secure front panel 40 and main panel 34, such as VELCRO or clasps.

Rear panel 42 extends downwardly between back free edges 62 of right and left panels 36 and 38 for protecting the back of the wearer's neck. Rear panel 42 also includes a fourth or inner surface 94 and an outer surface 96 and like front panel 40, is substantially shorter than right and left panels 36 and 38. However, rear panel 42 can be the same length or longer than the length of right and left panels 36 and 38. Preferably, rear panel 42 and right and left panels 36 and 38 are formed as a one-piece unitary member, as best seen in FIG. 2. However, each of right, left, and rear panels 36, 28, and 42 can be separately formed and attached any known manner, such as a sewing attachment.

A liner member 16 is disposed on the inside of cover member 12 that is both decorative and provides protection and warmth against inclement weather conditions. Specifically, liner member 16 includes first, second, third, and fourth sections 98, 100, 102, and 104 corresponding to right, left, front, and rear panels 36, 38, 40, and 42, respectively. First section 98 is disposed on inner surface 66 of right panel 36 and extends from bottom periphery 22 of crown member 12 to bottom free edge 64 of right panel 36, substantially covering inner surface 66. Similarly, second section 100 is disposed on inner surface 70 of left panel 38 and extends from bottom periphery 22 of crown member 12 to bottom free edge 64 of left panel 38, substantially covering inner surface 70. Likewise, third and fourth sections 102 and 104 are disposed on inner surfaces 86 and 94 of front rear panels 40 and 42, respectively.

Liner member 16, is preferably a thermal insulator such as fur, such that portions 106 of the fur liner will protrude all of the edges of right, left, front and back panels 36, 38, 40 and 42. However, liner member 16 can be formed of any flexible fabric material. It is further preferable, that first, second and back sections 98, 100 and 104 of liner member 16 be formed as a one-piece unitary member, however, each section can be separably formed and attached.

In operation, the wearer's head is inserted between right and left panels 36 and 38 into inner receiving area 28 of crown member 12 such that right and left panels rest over the wearer's ears and neck, front panel 40 covers the wearer's forehead and face, and back panel 42 covers the back of the wearer's neck. Since cover member 14 and liner member 16 are formed of flexible material, all of the panels are movable between folded and unfolded positions.

In the unfolded position, both right and left panels 36 and 38 are extended downwardly along with rear panel 42 Such that liner member 16 is adjacent the wearer. First and second fasteners 74 and 76 can be engaged under the wearer's chin to provide additional warmth and protection. Back free edges 62 of right and left panels allow the panels to easily engage via first and second fasteners 74 and 76 since the back edges 62 of the panels can be pulled in front of the wearer's neck.

When protection from the weather is not required, right, left, and rear panels 36, 38, and 42 can simply be pivoted upwardly towards main panel 34 and crown member 12 conveniently moving the panels out of the way without having to separate the panels from crown member 12. In the folded position, the outer surfaces 68, 72, 96 of right, left, and rear panels 36, 38, and 42 abut the outer surface 54 of main panel 34, leaving liner member 16 exposed. Due to the inherent nature of the canvas material of cover member 12, right, left, and rear panels 36, 38, and 42 will remain in the folded position without further attachment. However, to provide additional securement of these panels with respect to main panel 34, first and second fasteners 74 and 76 can be engaged ensuring that right, left, and rear panels 36, 38, and 42 will not become unfolded. To return the panels 36, 38 and 42 to the unfolded position, first and second fasteners 74 and 76 are simply disengaged and the panels are pivoted downwardly back to the unfolded position.

Since front panel 40 is not attached to right and left panels 36 and 38, it can move between folded and unfolded positions independently of panels 36, 38, and 42. In the unfolded position, front panel 40 extends generally downwardly at an angle with respect to right and left panels 36 and 38. When not needed for protection, front panel 40 is simply pivoted upwardly into a folded position such that outer surface 88 of front panel 40 is adjacent outer surface 54, and liner member 16 is exposed. Similar to right, left, and rear panels 36 38, and 42, due to the inherent nature of the canvas material of cover member 12 allows front panel 40 to remain in the folded position without further attachment. However, third and fourth fasteners 90 and 92 can be engaged to provide additional securing and ensuring that front panel 40 will not unfold.

By designing cover and liner members 14 and 16 in this fashion such that all of the panels are movable between folded and unfolded positions, one can employ headwear 10 in both good and bad weather. In addition, by fixedly attaching cover member 14 to crown member 12, cover member 14 is prevented from falling off of headwear 10.

While a particular embodiment has been chosen to illustrate the invention, it will be understood by those skilled in the art that various changes and modifications can be made therein without departing from the scope of the invention as defined in the appended claims.

What is claimed is:

1. Protective headwear, comprising:

a crown member having an inner surface and an outer surface, said crown member being substantially rigid;

a cover member disposed on said crown member, said cover member including:

a main panel attached to said outer surface of said crown member, said main panel being substantially covering said outer surface, and opposing first and second side panels extending from said main panel beyond said crown member, each of said first and second side panels being movable with respect to said main panel between folded and unfolded positions, said first side panel includes a first surface, said second side panel includes a second surface, said first side panel includes a first fastener, said second side panel includes a second fastener, said first and second fasteners being engaged when said first and second side panels are in said folded position, and said first and second fasteners form a snap-fit engagement, and said cover member includes third and fourth side panels extending from said main panel;

a thermal insulator liner is disposed on each of said first and second surfaces of said first and second side panels, respectively; and a flexible inner liner is disposed on said inner surface of said crown member.

2. Protective headwear according to claim 1, wherein each of said third and fourth panels includes third and fourth surfaces, respectively; and said thermal insulator liner is disposed on each of said third and fourth surfaces, respectively.

3. Protective headwear according to claim 1, wherein said first and second side panels are left and right panels respectively; and said third and fourth panels are front and rear panels respectively, said front and rear panels being substantially shorter in length than said right and left panels.

4. Protective headwear according to claim 1, wherein said third panel is movable between folded and unfolded positions and includes a third fastener for securing said third panel to said main panel; and said main panel includes a fourth fastener corresponding to said third fastener, said third and fourth fasteners being engaged when said third panel is in said folded position.

5. Protective headwear according to claim 1, wherein said first, second, and fourth panels are formed as a one-piece unitary member.

6. Protective headwear, comprising:

a crown member having an inner surface and an outer surface, said crown member being substantially rigid;

a cover member disposed on said crown member, said cover member including, a main panel attached to said outer surface of said crown member substantially covering said outer surface;

opposing first and second side panels movable between folded and unfolded positions and extending from said main panel beyond said crown member, said first side panel includes a first surface and a first fastener, and said second side panel includes a second surface and a second fastener corresponding to said first fastener;

opposing third and fourth side panels movable between folded and unfolded positions and extending from said main panel beyond said crown member, said third side panel includes a third surface, and said fourth side panel includes a fourth surface; and a thermal insulator liner being disposed on each of said first, second, third and fourth surfaces, respectively.

7. Protective headwear according to claim 6, wherein said first and second fasteners are engaged when said first and second side panels are in both said folded and unfolded positions.

8. Protective headwear according to claim 6, wherein each of said first, second, third, and fourth surfaces are inner surfaces, respectively; and a flexible inner liner is disposed on said inner surface of said crown member.

* * * * *